United States Patent [19]

Mitchell et al.

[11] Patent Number: 5,001,872

[45] Date of Patent: Mar. 26, 1991

[54] AIR JET LOOM REED APPARATUS AND METHOD

[75] Inventors: Allston T. Mitchell, Spartanburg; Roland B. Olcott, Greenville, both of S.C.

[73] Assignee: Southern-Loom Reed Manufacturing Co., Inc., Gaffney, S.C.

[21] Appl. No.: 513,010

[22] Filed: Apr. 23, 1990

Related U.S. Application Data

[63] Continuation of Ser. No. 270,029, Nov. 14, 1988, abandoned.

[51] Int. Cl.[5] ..... B24B 1/00

[52] U.S. Cl. ..... 51/281 R; 51/241 S; 51/270

[58] Field of Search ..... 51/34 R, 34 C, 166 R, 51/216 R, 270, 273

[56] References Cited

U.S. PATENT DOCUMENTS

| | | | |
|---|---|---|---|
| 2,493,619 | 1/1950 | Comstock | 51/34 C |
| 4,221,081 | 9/1980 | Everett | 51/270 |
| 4,327,591 | 5/1982 | Dybel et al. | 73/862.06 |
| 4,606,152 | 8/1986 | Michihara | 51/241 S |
| 4,640,316 | 2/1987 | Wakai | 73/198 |
| 4,782,632 | 11/1988 | Matechuk | 51/273 |

*Primary Examiner*—Frederick R. Schmidt
*Assistant Examiner*—Jack Lavinder
*Attorney, Agent, or Firm*—Bailey & Hardaway

[57] ABSTRACT

Method and apparatus are illustrated for enhancing the air flow characteristics in an air jet loom reed having a tunnel wherein the reed is removed from the loom and positioned in a frame for utilizing a rolling contact by a carriage which conveys measuring apparatus and buffing devices along a predetermined path at a desired sequence and speed of operation.

7 Claims, 4 Drawing Sheets

AIR JET LOOM REED APPARATUS AND METHOD

This application is a continuation of application Ser. No. 07/270,029, filed Nov. 14, 1988, now abandoned.

BACKGROUND OF THE INVENTION

U.S. Pat. No. 4,606,152 illustrates a method and apparatus for grinding or buffing a metal reed of an air jet loom by manually moving a buffer along the tunnel while the reed is positioned on the loom.

U.S. Pat. No. 4,640,316 illustrates another apparatus for treating an air jet loom reed while on the loom wherein air measuring apparatus is manually moved in sliding motion along the top of the loom reed.

Heretofore there was no method or apparatus available which would uniformly and consistently permit measurements of air flow and at the same time provide a means to make indicated adjustments to the loom reed to meet requirements as to air flow performance. Accordingly, objects of this invention include analysis and regulation of air flow for different types of filling with reduction in air consumption of the loom.

Another object of the invention is to permit the correction of problems associated with filling insertion and to assist in speeding up the loom while providing higher quality of cloth with fewer loom stops.

SUMMARY OF THE INVENTION

It has been found that a method and apparatus may be provided for optimizing air flow characteristics of an air jet loom by removing the reed from the loom and positioning same in a frame where a carriage is provided for rolling contact according to a predetermined path for measuring the air flow characteristics and for altering the physical nature of the air tunnel to accommodate improved air flow.

BRIEF DESCRIPTION OF THE DRAWINGS

The construction designed to carry out the invention will be hereinafter described, together with other features thereon.

The invention will be more readily understood from a reading of the following specification and by reference to the accompanying drawings forming a part thereof, wherein an example of the invention is shown and wherein.

DESCRIPTION OF A PREFERRED EMBODIMENT

Figure 1:
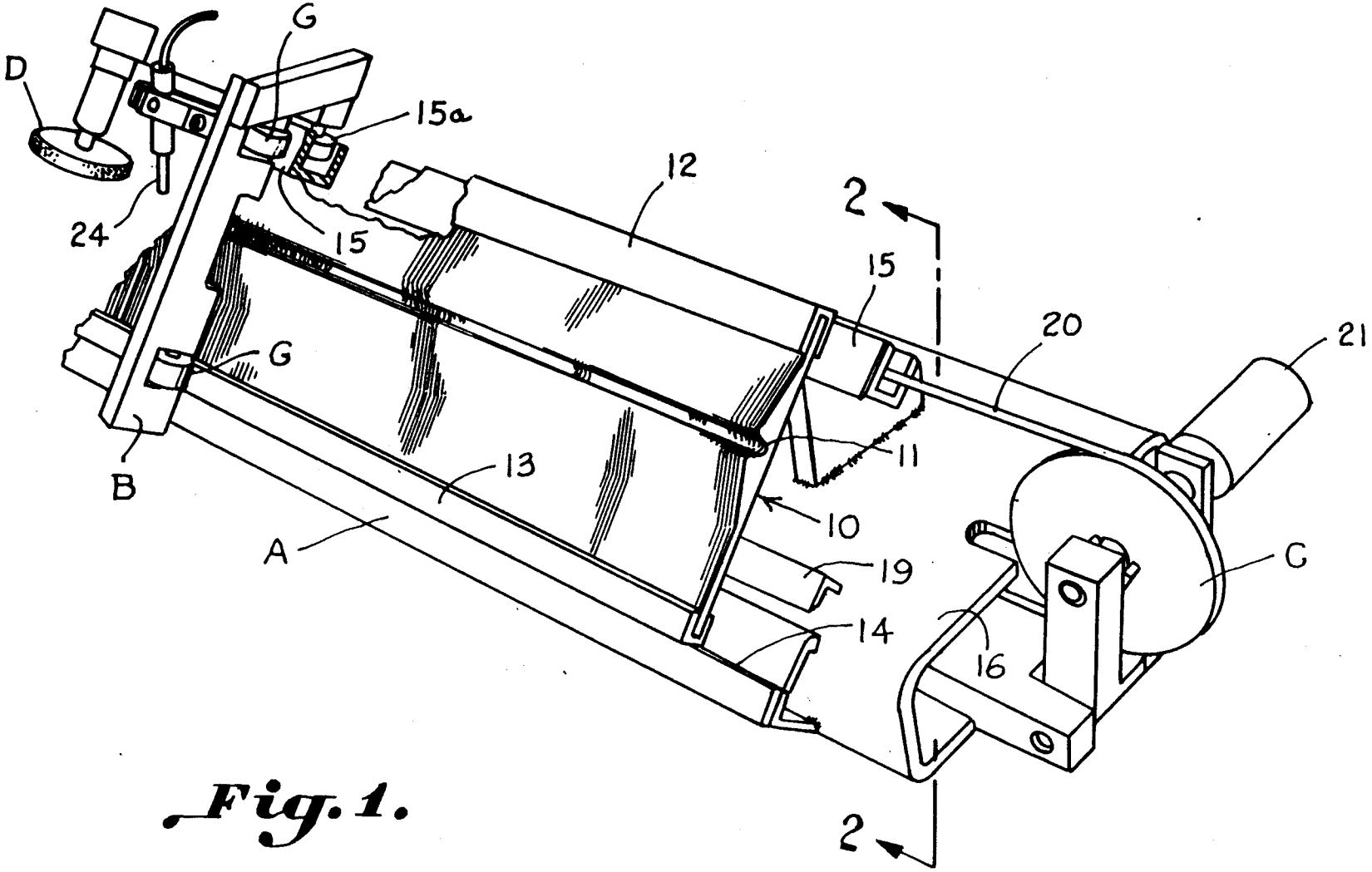
FIG. 1 is a perspective view schematically illustrating a frame for positioning a loom reed in inverted position remote from the loom together with a driving apparatus for moving the carriage.

The drawings illustrate a method and apparatus for enhancing air flow characteristics in an air jet loom reed broadly designated at 10. The reed 10 has a tunnel 11 and a bottom channel 12. The air jet loom reed is first removed from an air jet loom (not shown). The air jet loom reed is then positioned in a mounting frame A in a fixed preferably inverted at least partially upright position. In inverted position the bottom channel 12 is at the top, with a top channel 13 on a lower guide rail 14 of the frame A. The rail 14 of the frame A is opposite an upper frame rail formed by a channel 15.

A carriage B driven by a pulley C is illustrated for driving a buffing device D and an air measuring device E at a predetermined speed along the reed. The carriage is illustrated as being suitably supported as by a wheel F which rolls on the bottom channel 12 of the loom reed. Thus, the path of the buffing device relative to the tunnel of the air jet loom reed is located with respect to an upper portion of the loom reed when fixed in the inverted position.

The frame A is carried by a tubular base support 16 and the lower guide rail 14 is supported by a bracket 17 while the channel 15 is carried by posts 18. A bar magnet 19 is provided to hold the reed 10 in position upon the frame A. Rolling contact of the carriage is maintained by the rollers G (FIG. 2) with the respective reed channels 12 and 13. A roller 15*a* is provided for positioning the carriage in respect to the channel 15.

Figure 2:
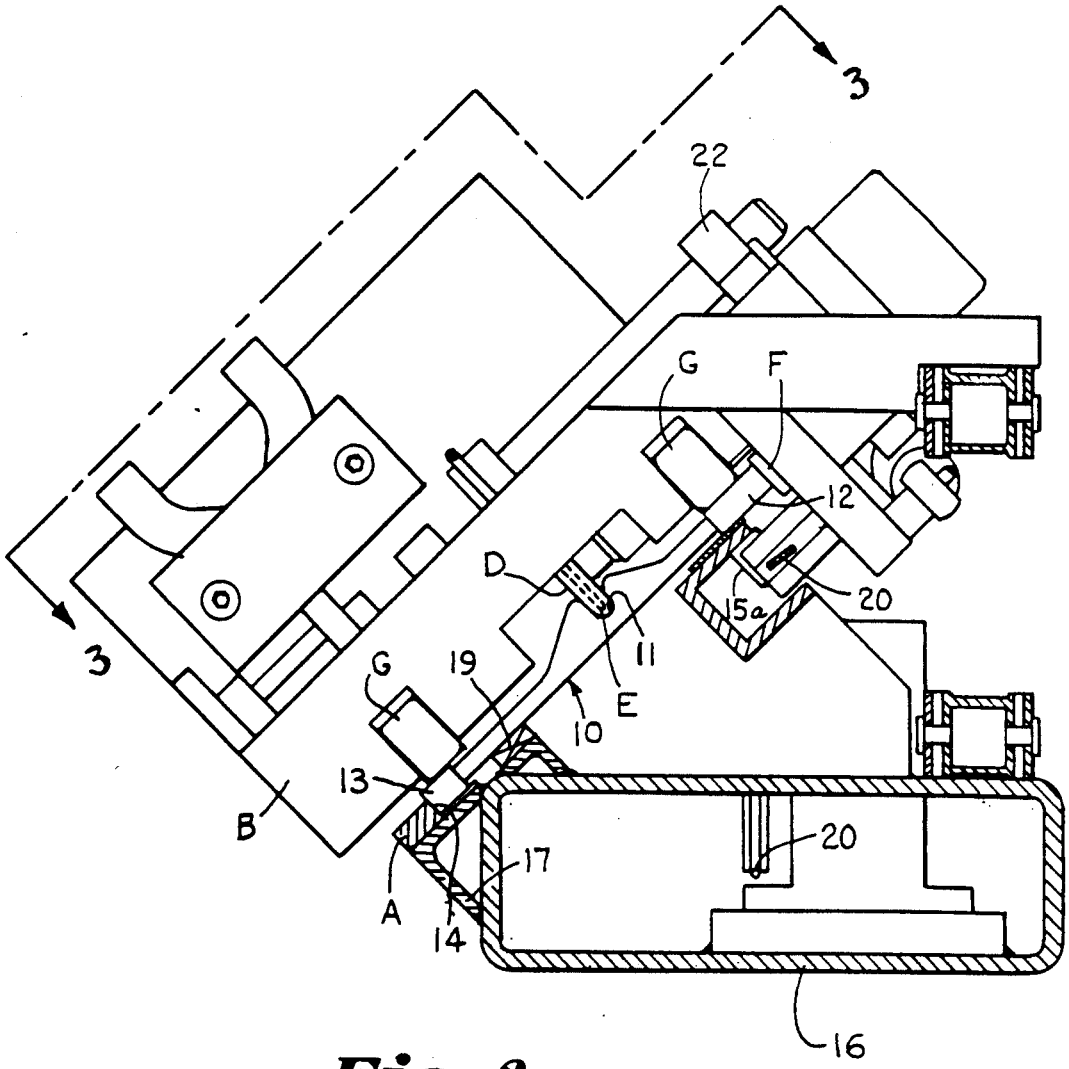
FIG. 2 is a transverse sectional elevation taken on the line 2—2 in FIG. 1 with a carriage illustrated as being positioned upon the loom reed.

Thus, FIGS. 1 and 2 illustrate a universal mounting frame A which can be used for all known air jet reeds of a tunnel variety of varying lengths, heights and locations of air jet tunnel relative to top or bottom channel of the reed. The reed is held in place in the frame by the lower guide or alignment rail 14 and the magnetic bar holder 19 together with the gravity effect of the weight of the reed.

The drive pulley C together with a nylon coated cable 20 provide uniform or other predetermined motion to the carriage along the reed. The pulley is driven by a motor 21. It is important to note in the drawings that the top channel 13 of the reed 10 (as mounted in the loom) is located along the bottom of the frame and the bottom channel 12 of the reed 10 (as mounted in the loom) is located exposed at the top of the frame (e.g. This is the reverse of the arrangement in the air jet loom).

This is important because it exposes the bottom of the reed channel for exact and uniform rolling motion of the carriage along any type of reed. All types of loom reeds have critical reed dimensions which are referenced from the bottom of the bottom channel and from the front of the bottom channel to the sides of the tunnel and to the bottom of the tunnel. Dimensions to and from the top channel of the reed are considerably less critical and in fact can vary from one reed to another within limits without effecting the function of the reed in the weaving process.

Figure 3:
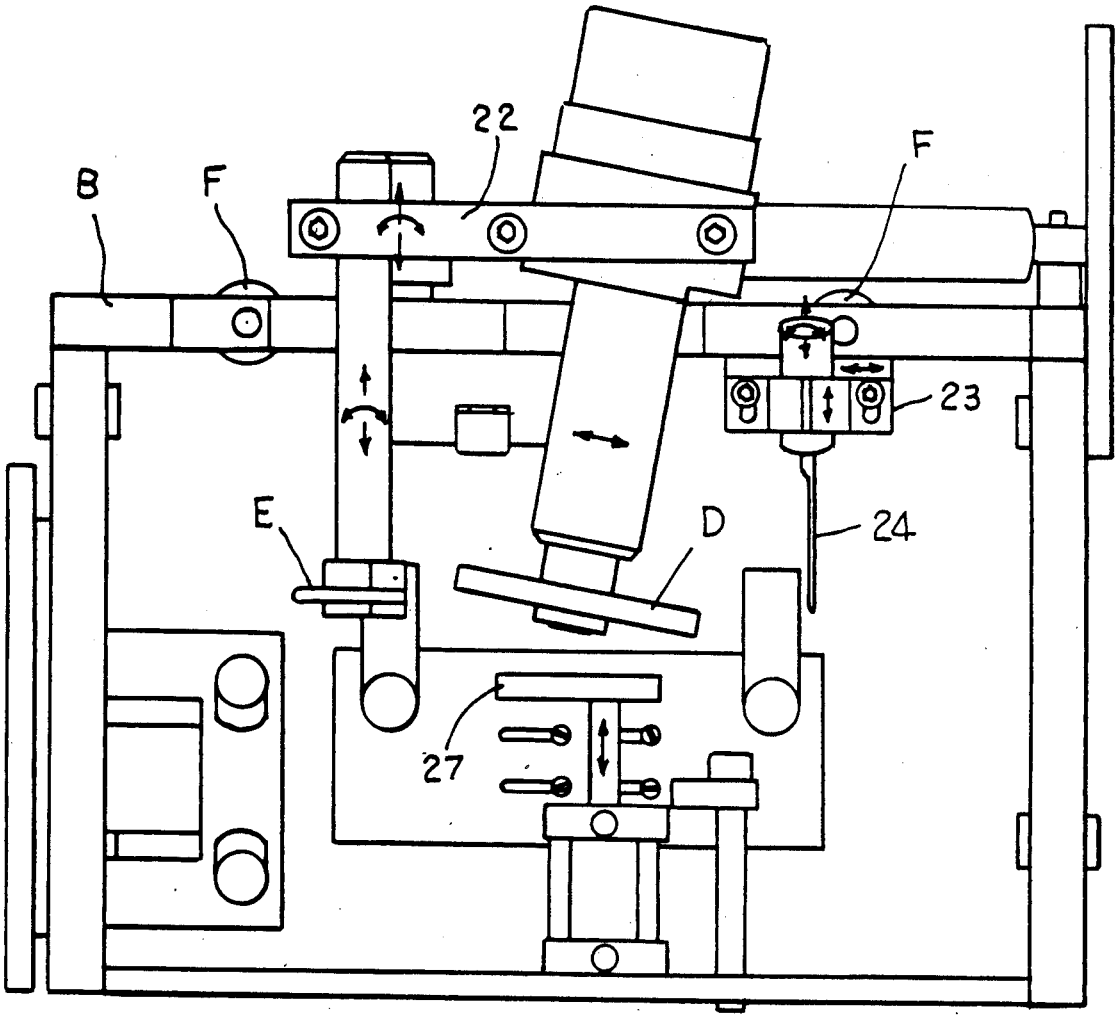
FIG. 3 is a plan view of the carriage taken on the line 3—3 in FIG. 2.

Universal adjustment of the air measuring device E, illustrated as a Pitot tube within the air jet tunnel 11, is provided by the mounting which also provides universal adjustment of the buffing or grinding wheel D in and around any and all sections of the air jet tunnel. Various types of buffing or grinding wheels designed for different buffing purposes may be utilized. Any such device or operation for altering the surface as configuration of the tunnel is referred to herein as a buffer or buffing. A universal mounting 23 (FIG. 3) for an air jet nozzle as illustrated at 24 is provided at any desired location relative to the tunnel and at a variable distance from the Pitot tube. The carriage B may be variable in width to permit extensive changes of the distance of the Pitot tube from the nozzle and also permit use of multiple nozzles if this is desirable. This feature is useful because at present the location of the nozzles on the loom relative to the tunnel are fixed. This is true in the case of each type of loom. This capability provides for a means to determine the optimum nozzle location for different types of filling materials depending on count, denier, twist, etc.

Figure 4:
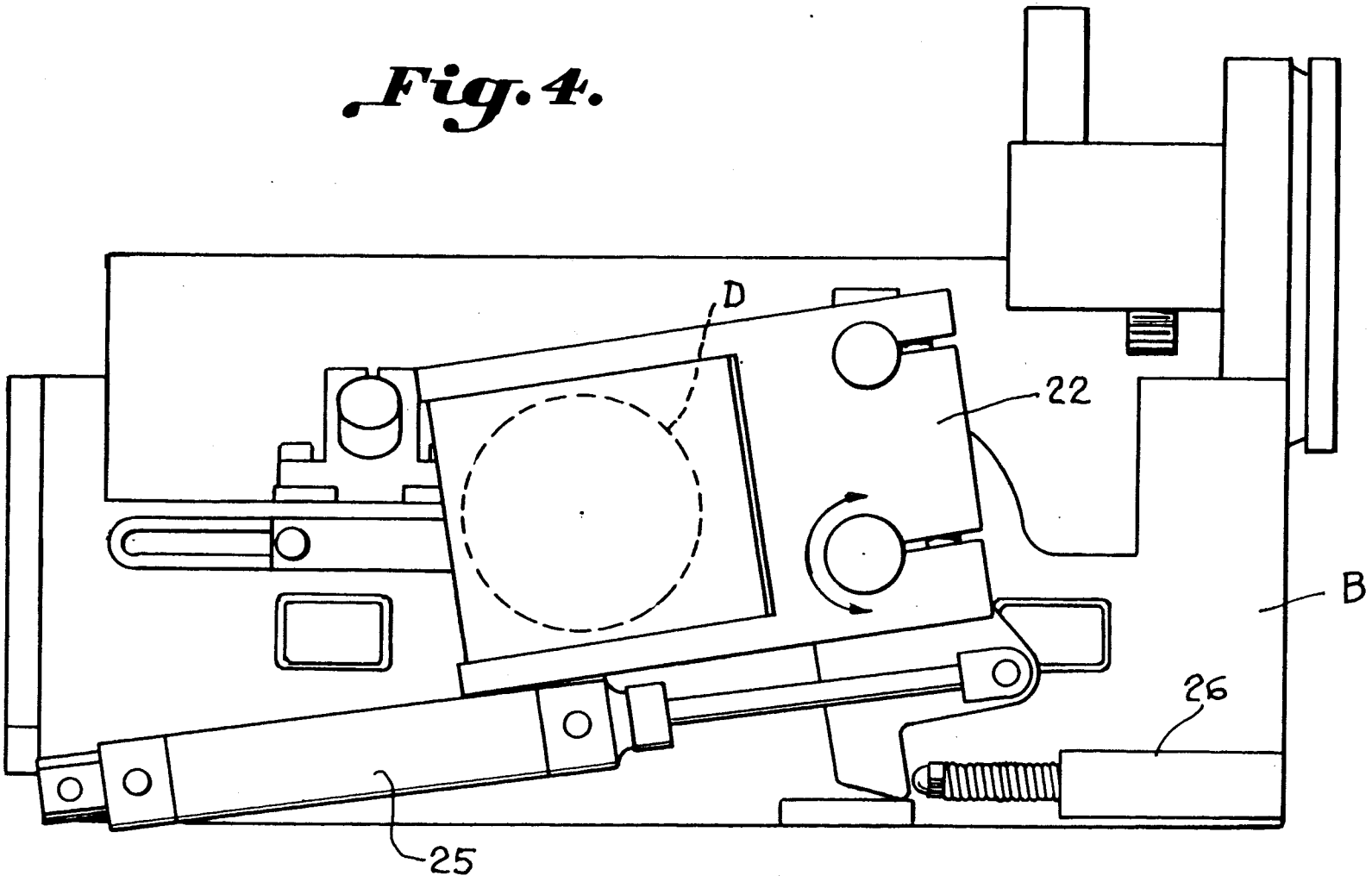
FIG. 4 is a plan view illustrating an apparatus for positioning a buffer for altering the loom reed in accordance with the invention.

An air cylinder 25 and a potentiometer 26 are illustrated in FIG. 4 connected in relationship to the buffing mechanism universal mounting 22. The buffing mechanism having the wheel D is located by moving it in or out of the desired position. A desired pressure of the buffing wheel may be applied to any selected part of the tunnel. Further, by means of the potentionmeter the speed of the wheel D is regulated providing for a constant surface speed during its motion across the air jet reed and accommodating any wear in the buffing wheel. Since the Pitot tube E also has a universal mounting capability both up and down and in and around of the air jet reed tunnel air flow, i.e. pressure drop, measurements may be made in any locations in the profile of the air jet tunnel.

A nozzle 27 of vacuum system is located in the carriage. It is moved into position automatically when buffing is performed, and out of the way when measuring is performed. Its purpose is to clean the reed and constantly remove any particles created during the buffing process. Thus, apparatus has been provided for measuring air flow for all types of air jet reeds for all known air jet looms.

The measuring of air flow by pressure drop from a known pressure can be performed anywhere in the cross section of the tunnel and at any distance from the Pitot tube to the nozzle. A variety of nozzles can be used and the nozzle location is variable relative to the tunnel and the Pitot tube. The number of nozzles is also variable.

Air pressure to the nozzles can be set at variable pressures. Once air flow measurements are taken with potentially a variety of methods, the air flow can be recorded in any suitable way. Adjustments in air flow throughout the cross section of the air jet reed tunnel and over the full length of the air jet reed tunnel are possible. Variations in air flow can be produced in both cross sections and over the length of the air jet reed to accommodate optimum filling stop arrangements, different fillings, air consumption and resulting power conservation, loom speed as measured in picks per minute, and cloth quality. These adjustments are accomplished by removing or creating slight burrs on the metal profile dents, varying the surface finish of the metal profile dents, modifying the shape of the metal profile dent to increase or decrease air flow and to increase or decrease turbulence, varying nozzle location relative to air jet tunnel, and changing nozzle design.

While a preferred embodiment of the invention has been described using specific terms, such description is for illustrative purposes only, and it is to be understood that changes and variations may be made without departing from the spirit or scope of the following claims.

What is claimed is:

1. The method of enhancing air flow characteristics in an air jet loom reed having a tunnel intermediate a free top and a bottom releasably held by a lay when mounted in a loom comprising the steps of:

removing the air jet loom reed from an air jet loom;

inverting said air jet loom reed and positioning same held in fixed inverted at least partially upright position with the top of the reed below the tunnel;

rolling a buffing device along said reed on vertically spaced rollers carried respectively adjacent said top and said bottom of the reed; and guiding the movement of said buffing device, relative to the tunnel of the air jet loom reed located between said rollers, on the bottom of said loom reed when held fixed in said inverted position.

2. The structure set forth in claim 1 including supplying air to said tunnel and measuring resulting air pressure in the tunnel.

3. The structure set forth in claim 1 including driving said buffing device along said path at a predetermined speed.

4. Apparatus for enhancing the air flow characteristics in an air jet loom reed having a tunnel for use in an air jet loom comprising:

a frame remote from said air jet loom positioning said air jet loom reed in fixed at least partially upright position;

a carriage for positioning a variety of devices for treating the reed;

devices for buffing said tunnel and for measuring air flow in said tunnel carried by said carriage;

spaced rollers on said carriage on each side of said tunnel carried on a top and bottom respectively of the loom reed;

a drive for moving said carriage on said rollers at a predetermined speed along said reed; and means for guiding said carriage independent of said rollers for moving at said predetermined speed relative to the tunnel of the air jet loom reed.

5. The structure set forth in claim 4 including means positioning said reed in fixed at least partially upright position in said frame.

6. The structure set forth in claim 4 including a vacuum nozzle carried by said carriage to remove buffed away parts of the reed.

7. The structure set forth in claim 4 including magnetic means positioning said loom reed in inverted upright position.

* * * * *